US006798143B2

(12) United States Patent
Frayssinet et al.

(10) Patent No.: US 6,798,143 B2
(45) Date of Patent: Sep. 28, 2004

(54) FLAT DISPLAY SCREEN CATHODE PLATE

(75) Inventors: Thierry Frayssinet, Jacou (FR); Bernard Bancal, Meyreuil (FR); Jean-Marc Dubois, Montferrier/Lez (FR); Mathias Richter, Rogues (FR)

(73) Assignee: Pixtech S.A., Rousset (FR)

( * ) Notice: Subject to any disclaimer, the term of this patent is extended or adjusted under 35 U.S.C. 154(b) by 0 days.

(21) Appl. No.: 09/817,480

(22) Filed: Mar. 26, 2001

(65) Prior Publication Data

US 2002/0047559 A1 Apr. 25, 2002

(30) Foreign Application Priority Data

Mar. 28, 2000 (FR) ..... 00 03916

(51) Int. Cl.[7] ..... G09G 3/10
(52) U.S. Cl. ..... 315/169.1; 345/74.1; 313/497
(58) Field of Search ..... 315/169.3, 169.1; 313/309, 310, 313, 326, 336, 351, 422, 495–497; 345/74.1, 55

(56) References Cited

U.S. PATENT DOCUMENTS

| | | | | | |
|---|---|---|---|---|---|
| 5,508,584 | A | * | 4/1996 | Tsai et al. | 313/307 |
| 5,543,691 | A | * | 8/1996 | Palevsky et al. | 313/309 |
| 5,614,781 | A | * | 3/1997 | Spindt et al. | 313/292 |
| 5,903,108 | A | * | 5/1999 | Mougin et al. | 313/496 |
| 5,929,560 | A | | 7/1999 | Trujillo et al. | 313/495 |

* cited by examiner

*Primary Examiner*—Haissa Philogene
(74) *Attorney, Agent, or Firm*—Duane Martin LLP

(57) ABSTRACT

A cathode plate of a flat display screen of the type including a set of electron emission cathode conductors, organized in columns, a set of electron extraction grid conductors, organized in rows, and a peripheral protection area, surrounding an active area taking part in the display, to prevent propagation of secondary electrons out of the perimeter of the protection area.

11 Claims, 3 Drawing Sheets

FLAT DISPLAY SCREEN CATHODE PLATE

BACKGROUND OF THE INVENTION

1. Field of the Invention

The present invention relates to the field of flat display screens, and more specifically to a cathodoluminescent screen, the anode of which supports phosphor elements likely to be excited by electron bombarding. This electron bombarding may originate from microtips, from low extraction potential layers, or from a thermo-ionic source. To simplify the present description, only microtip screens will be considered hereafter, but it should be noted that the present invention generally relates to the various above-mentioned types of screens and the like.

2. Discussion of the Related Art

In a microtip screen, a so-called cathode plate is provided with electron emission microtips and is arranged to face a so-called anode plate provided with phosphor elements. The cathode is associated with a grid provided with holes corresponding to the locations of the microtips. This device uses the electric field which is created between the cathode and the grid to extract electrons from the microtips. These electrons are then attracted by the phosphor elements of the anode if said elements are properly biased.

The present invention more specifically relates to a cathode of a flat display screen associated with at least one so-called extraction grid, that is, a cathode plate.

The microtips are generally deposited on cathode conductors organized in columns that form active electron emission areas. The columns are addressable individually. The extraction grid is organized in rows perpendicular to the cathode columns, also addressable individually. In a color screen, the anode is for example provided with alternate strips of phosphor elements, each corresponding to a color (red, green, blue). The strips are then generally parallel to the cathode columns and can be separated from one another by an insulator. The phosphor elements are deposited on electrodes formed of corresponding strips of a conductive layer, for example made of indium and tin oxide (ITO) for a transparent anode. In a monochrome screen, the anode supports a plane of phosphor elements of same color or two separately addressable sets of phosphor elements of same color, for example, organized in alternate strips as in a color screen. The intersection of a cathode column and of a grid row defines a screen pixel. For a color screen, the sets of red, green, blue strips of the anode are often alternately biased with respect to the cathode so that the electrons extracted from the microtips of a pixel of the cathode-grid are alternately directed towards the phosphor elements of each of the colors. In some color screens, the intersection of a grid row with a cathode column then defines a sub-pixel of a color. In other screens, the pixels may be defined individually by elementary patterns of phosphor elements of each color on the anode side, these chips then being addressable, for example, by groups of same color.

In some screens, the anode, while being formed of several sets of strips or of elementary patterns of phosphor elements, is not switched by set of strips or patterns. All strips then are at a same potential. The anode is then said to be unswitched, as opposed to so-called switched anodes where the colors are sequentially biased.

Generally, the grid rows are sequentially biased to a potential on the order of 80 volts, while the strips or sets of phosphor elements to be excited are biased under a voltage of several hundreds, or even several thousands of volts, via the ITO strip on which the phosphor elements are deposited. In the case of a switched anode, the ITO strips supporting the other strips of phosphor elements are at a low or zero potential. The cathode columns are brought to respective potentials ranging between a maximum emission potential and a no-emission potential (for example, respectively 0 and approximately 40 volts). The brightness of a color component of each of the pixels in a line is thus determined. The choice of the values of the biasing potentials is linked to the characteristics of the phosphor elements and of the microtips. Conventionally, below a potential difference of approximately 50 volts between the cathode and the grid, there is no electron emission, and the maximum electron emission used corresponds to a potential difference on the order of 80 volts.

The manufacturing of microtip screens uses the techniques currently used in integrated circuit manufacturing. In particular, the cathode and the grid are generally formed of thin layer depositions on a substrate, for example made of glass, forming the screen bottom. The anode is generally formed on another glass substrate forming, in this example, the screen surface. The anode and the cathode-grid are formed independently from each other on the two substrates, then are assembled by means of a peripheral seal, while leaving, between the grid and the anode, an empty space to enable circulation of the electrons emitted by the cathode to the anode. Once finished, the internal screen space is thus encircled by the seal, generally made of glass, which seals the anode and cathode plates. This seal must be placed distant from the active areas of the anode and of the cathode, in particular to enable the necessary interconnections of the elements. Reference will be made hereafter to the active screen area, be it on the cathode-grid side or on the anode side. A space is generally left between this active area of the anode and of the cathode and the peripheral seal. This space is most often made of an insulating material, for example, silicon oxide due to the use of technologies derived from those used in integrated circuit manufacturing.

A problem which is posed in conventional screens is the occurrence of destructive phenomena due to the forming of arcs at the periphery of the screen or of its active area. Such phenomena are due to the developing of a charge area at the periphery of the active area in the insulating space separating said area from the sealing wall. This charge area also propagates at the seal surface and thus progressively comes closer to the other electrode.

This positive charge area is generated by electrons emitted towards the anode during screen operation, and which fall back on the insulating areas at the edge of the active area. The developing of this positive charge area is self-fed by the fact that the more the positive area increases, the more it attracts new electrons. This charge area ends up causing either arcs between the screen edge and the cathode electrodes, or a parasitic emission phenomenon.

SUMMARY OF THE INVENTION

The present invention aims at overcoming the disadvantages of conventional screens.

A feature of the present invention is to provide, on the cathode-grid side, a peripheral protection area between the active area, that is, the surface participating in the display, and the peripheral sealing wall. This peripheral protection area, formed of at least one conductive section, has the function of preventing the propagation of secondary electrons to the sealing wall by trapping the electrons that fall back on this or these sections. The conductive section(s) occupy, in a peripheral pattern of the active area, a sufficiently large perimeter to make the secondary electrons likely to cross the barrier thus formed negligible. Across the width (between the active area and the closest portion of the sealing wall), the conductive section(s) cover a distance greater than the distance that most secondary electrons that may be emitted are likely to cross. This distance depends on the energy of these secondary electrons, which itself depends on the energy of the primary electrons and on the inter-electrode space. For a given sizing and given operating conditions, it is known to statistically determine the energy distribution of the secondary electrons, and thus the energy of the statistic majority of secondary electrons.

According to first embodiment, the protection area is formed of at least one conductive ring formed in a layer deposited, with an interposed insulating layer, on the so-called extraction grid. In screens where an additional grid (for example, a focusing grid) is provided on the extraction grid, the peripheral conductive ring can be formed in the layer of formation of this additional grid, at the periphery of the active area.

According to a second preferred embodiment, the peripheral protection area is formed in at least one of the conductive levels from among the level in which the cathode conductors are formed and the level in which the extraction grid is formed.

This preferred embodiment has several aims.

A first aim is that the forming of the protection ring results in no additional complexity in the cathode-grid manufacturing.

Another object of the present invention is to introduce no additional manufacturing step in the method of forming a flat display screen cathode plate.

Another object is to solve problems specific to the cathode-grid plate.

Indeed, the grid rows and the cathode columns are addressed individually. They thus require a large number of conductive sections on two edges of the cathode plate that risk being hampered (mechanically or functionally) by a peripheral conductive ring. As a comparison, on the anode side, only three conductors come out for a color screen since the sets of strips are generally addressed simultaneously per color.

More specifically, the present invention provides a cathode plate of a flat display screen of the type including a set of electron emission cathode conductors, organized in columns, a set of electron extraction grid conductors, organized in rows, and a peripheral protection area, surrounding an active area taking part in the display, to prevent propagation of secondary electrons out of the perimeter of the protection area.

According to an embodiment of the present invention, the peripheral protection area is formed of a conductive ring surrounding the majority of the active area and formed in an accessible conductive level.

According to an embodiment of the present invention, the cathode plate includes, on either side of the extraction lines, at least one additional accessible conductive line.

According to an embodiment of the present invention, the cathode plate includes, on either side of the electron emission columns, at least one additional conductive column.

According to an embodiment of the present invention, the grid lines and the cathode columns belong to a piling of thin layers with at least one interposed insulating layer, the additional line(s) and/or column(s) being formed in the respective levels of the extraction lines and of the emission columns.

According to an embodiment of the present invention, the additional column(s) are at least partially accessible.

According to an embodiment of the present invention, the cathode emission columns extend under the additional line (s), the grid extraction lines extending over the additional column(s).

According to an embodiment of the present invention, the additional column(s) are adapted to being biased to a potential corresponding, for the emission columns, to no electron emission, the additional line(s) being adapted to being biased to a potential corresponding, for the extraction lines, to no addressing.

According to an embodiment of the present invention, the number of additional columns and/or lines is a function, in particular, of the column and line conductor width and on the angle of the electron emission cone of the cathode.

The present invention also provides a flat display screen including a cathode provided with active electron emission regions, a cathodoluminescent anode provided with at least one active area of phosphor elements, and a grid for extracting electron emitted by the active regions of the cathode towards the phosphor elements, the cathode and the grid being formed on a cathode plate of the present invention.

According to an embodiment of the present invention, the number of additional columns and/or lines depends, along others, on the distance separating the cathode plate from the cathodoluminescent anode.

According to an embodiment of the present invention, the screen includes a circuit for biasing and addressing the different conductors of the cathode, of the grid and of the anode, provided with connections for biasing the additional lines and/or columns.

The foregoing objects, features and advantages of the present invention will be discussed in detail in the following non-limiting description of specific embodiments, in conjunction with the accompanying drawings.

DETAILED DESCRIPTION

Figure 1A:
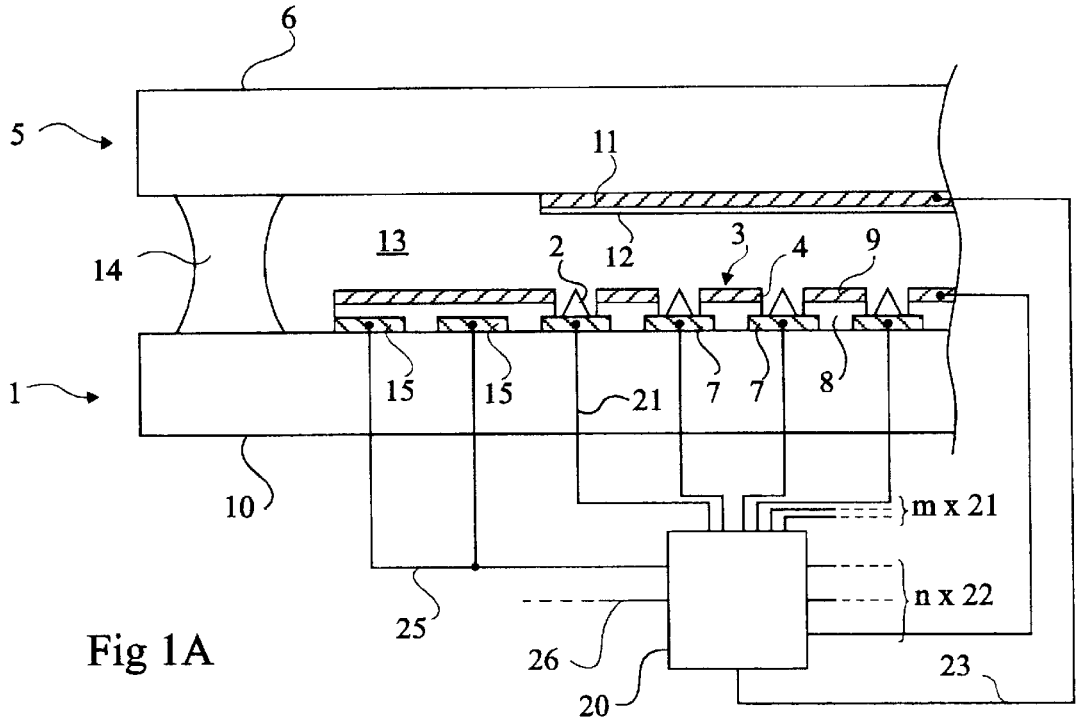
FIGS. 1A, 1B, 1C, and 1D show, partially and in cross-section view, a cathode plate associated with an anode plate to form a flat display screen according to a preferred embodiment of the present invention.

The same elements have been referred to with the same references in the different drawings. For clarity, only those elements necessary to the understanding of the present invention have been shown in the drawings and will be described hereafter. In particular, the forming of the control circuits of a flat screen according to the present invention has not been detailed, since it is either known or within the abilities of those skilled in the art based on the explanations given hereafter. Similarly, the different individual steps of manufacturing of an anode plate and of a cathode plate of a screen according to the present invention will only be detailed when linked to the present invention, the other steps being conventional or within the abilities of those skilled in the art.

A feature of the present invention is, according to the preferred embodiment, to provide on the cathode side a conductive protection area which is accessible (to the electrons of the internal space), formed of tracks following the patterns of the cathode columns and/or of the grid rows. Thus, according to the present invention, at least one additional cathode column and/or at least one additional grid row is provided on either side of the active area to act as a protection ring.

Another feature of the preferred embodiment of the present invention is that the organization of the cathode columns and of the grid lines is regular not only on the active screen area taking part in the display, but also at the level of the peripheral area functionally forming a protection ring, so that the grid rows taking part in the display continue over the protection cathode columns and/or the cathode columns taking part in the display continue under the grid rows taking part in the protection.

Another feature of the preferred embodiment of the present invention is that the cathode columns and/or the grid rows located outside of the active area are biased to a fixed potential or to the ground, independently from the addressing of the columns and rows taking part in the display. Preferably, this biasing is, especially for the accessible conductive sections, performed via a resistor of high value to limit the high current that could appear in case of an incidental flash, while enabling evacuation of the charges.

Figure 1B:
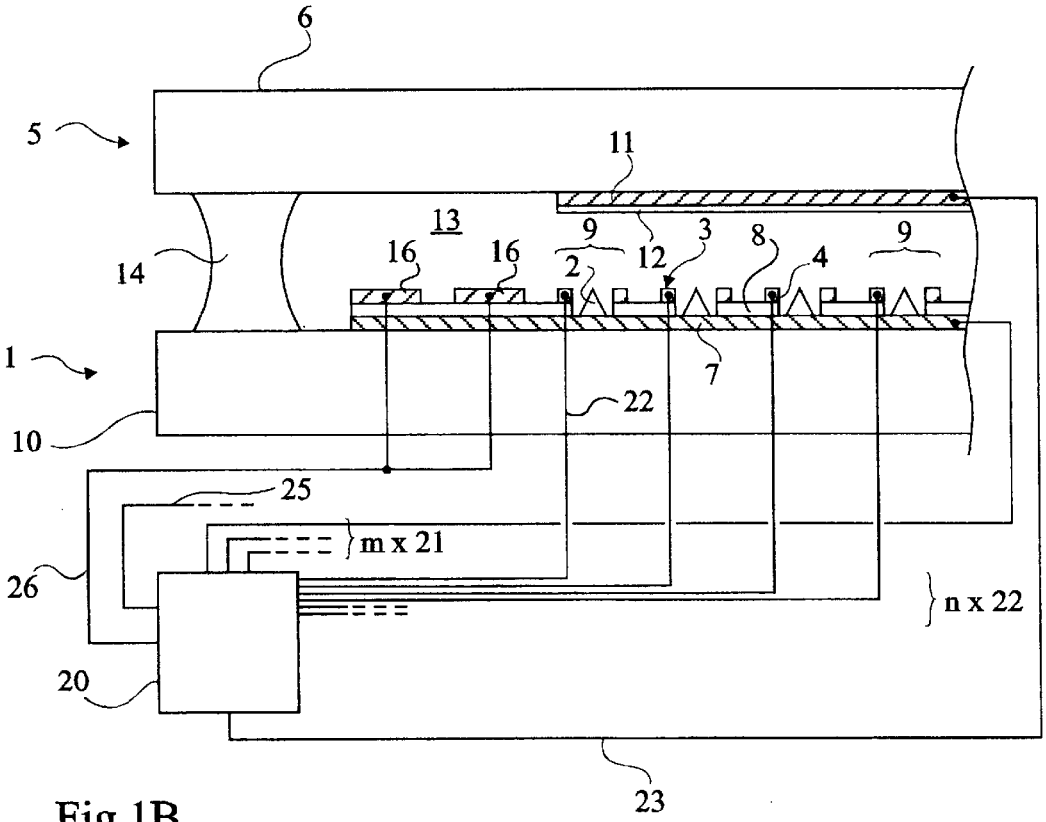
Figure 1C:
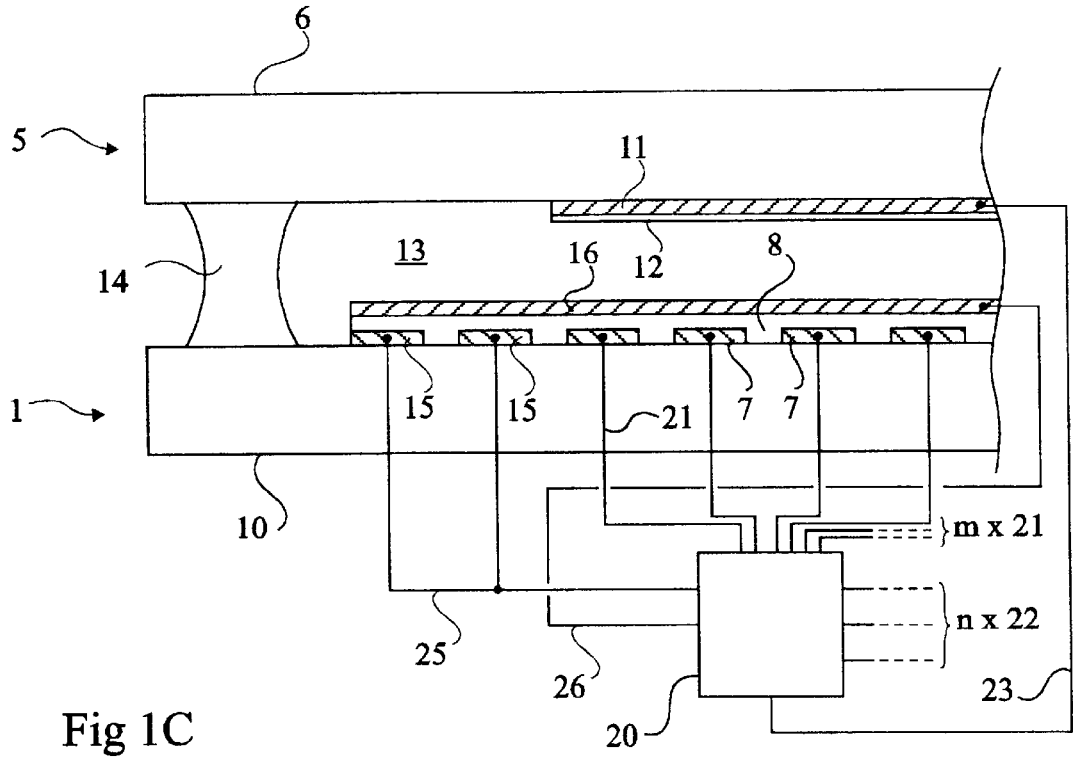
Figure 1D:
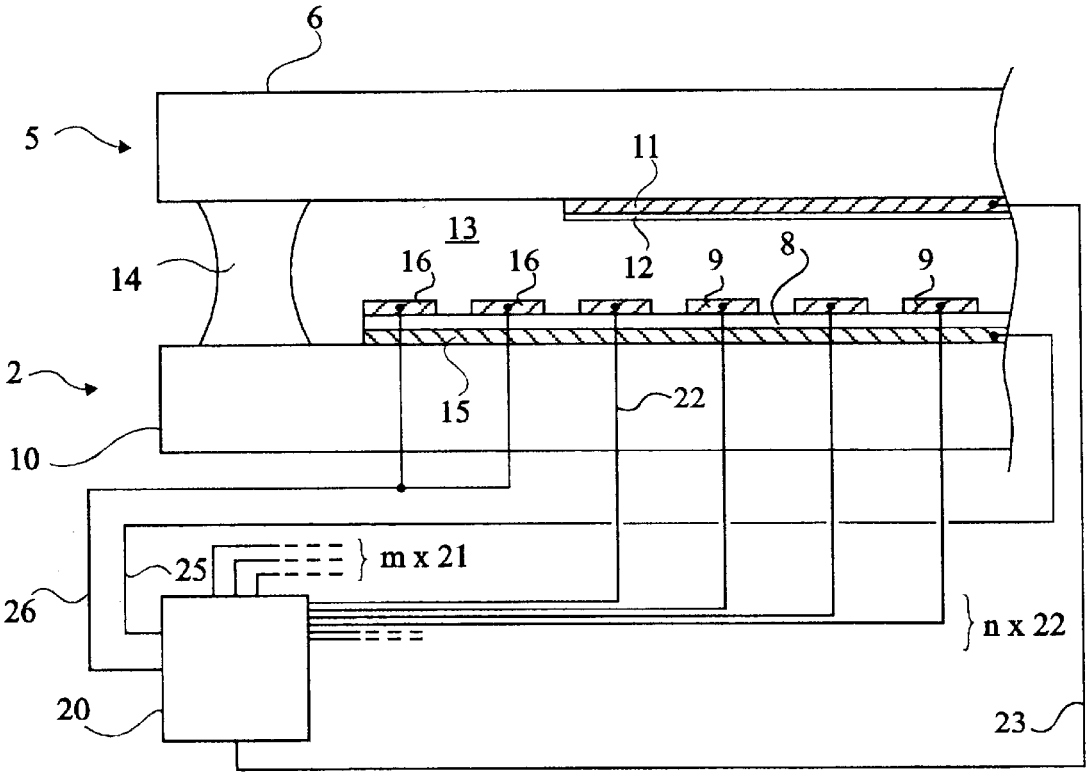
Figure 2:
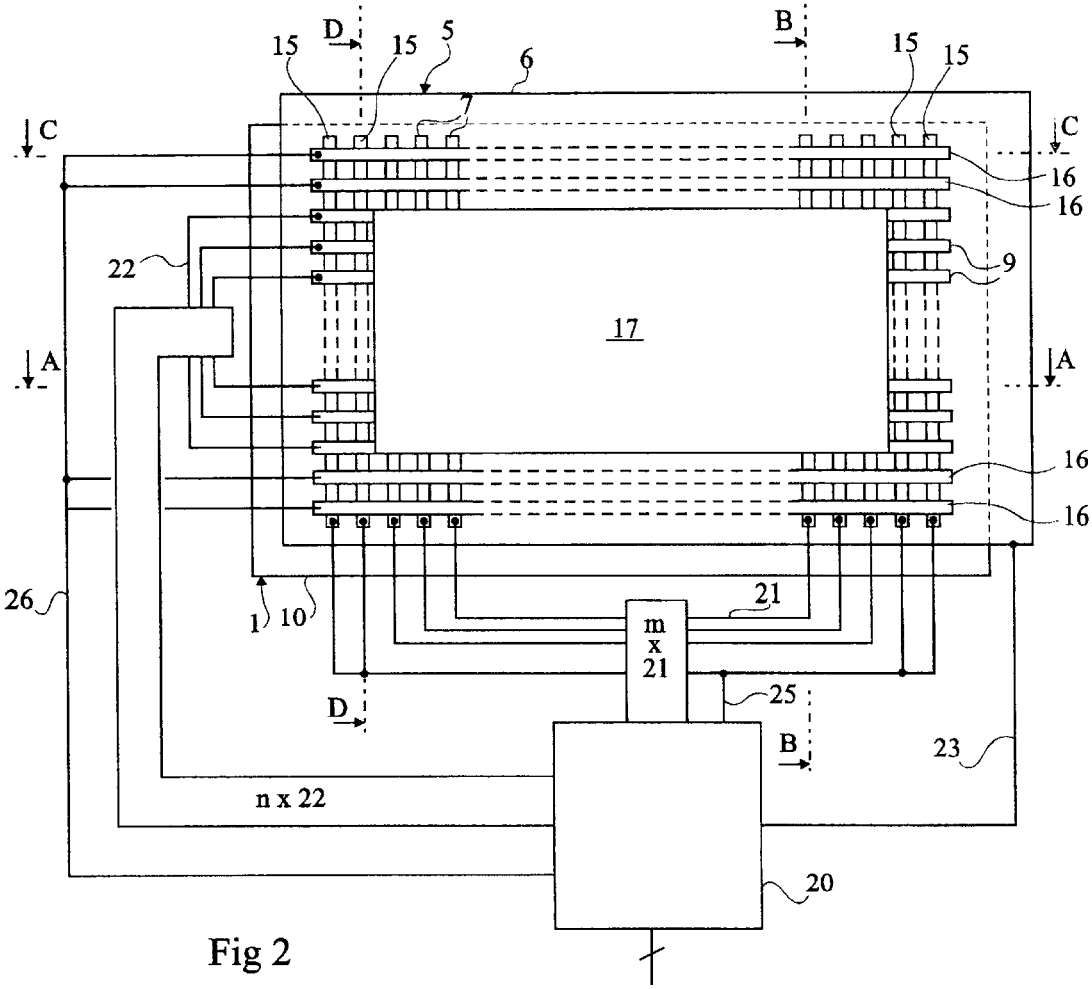
FIG. 2 is a simplified top view of the screen of FIGS. 1A to 1D.

FIGS. 1A, 1B, 1C, and 1D show different cross-section views of the second embodiment of a flat display screen according to the present invention. These drawings are cross-sections taken along different lines of the screen, such as it appears in FIG. 2, which shows this embodiment in top view. The cross-section lines of FIGS. 1A to 1D are illustrated in the representation of FIG. 2 by stripe-dot lines bearing the reference letters of the corresponding FIG. 1. FIGS. 1A and 1B are cross-section views along, respectively, a grid extraction line and a cathode emission column that take part in the display. FIGS. 1C and 1D are cross-section views outside of the active area, along, respectively, a grid line and a cathode column. The present invention will be described hereafter in relation with FIGS. 1A to 1D and with FIG. 2.

Conventionally, a screen according to this embodiment of the present invention is formed of a cathode 1 with microtips 2 (FIGS. 1A and 1B) and of a grid 3 provided with holes 4 (FIGS. 1A and 1B) corresponding to the locations of microtips 2. Cathode 1 is placed opposite to a cathodoluminescent anode 5, a glass substrate 6 of which forms, for example, the screen surface. Microtips 2 are formed on a resistive layer (not shown) deposited on cathode conductors 7 organized in columns. Most often, microtips 2 are formed on a resistive layer (not shown) deposited on the cathode conductors organized in meshes from a conductive layer, the microtips being arranged inside of the meshes defined by the cathode conductors in columns. Grid 3 is formed of a conductive layer organized in rows 9 perpendicular to the cathode conductor columns with an interposed insulator 8 between the cathode and the grid. Grid rows 3 are provided with a hole 4 above each microtip 2, and so is insulator 8, which is above holes 4. The intersection of a column 7 of cathode 1 and of a row 9 of grid 3 defines a screen pixel. For clarity, a single microtip 2 has been shown to be associated with each cathode conductor 7. It should however be noted that the microtips are generally several thousands per screen pixel. The cathode-grid is formed on a substrate 10, for example made of glass, forming in this example the screen bottom.

Assuming that the representation of FIGS. 1A to 1D and 2 corresponds to a monochrome screen, substrate 6 of anode 5 supports an electrode 11 formed of a plane of a transparent conductive layer such as indium and tin oxide (ITO). Phosphor elements 12 of same color are deposited on this electrode 11. In the case of a color screen (not shown), the anode may be provided with alternate strips or with elementary patterns of phosphor elements, corresponding to the different colors (red, green, blue) and biased by sets of strips or patterns, or by a conductive plane. It should be noted that the present invention does not act upon the anode, which is thus perfectly conventional.

An empty space 13 is formed between the anode and the cathode-grid upon assembly of substrates 6 and 10. Spacers (not shown) generally regularly distributed between grid 3 and anode 5 define the height of space 13 and a peripheral seal 14 ensures the tightness of the assembly.

In the example illustrated by the drawings, it is assumed that the screen includes an active display area including m cathode columns 7 and n grid lines 9. The active area dedicated to the display is symbolized by a rectangle 17 in FIG. 2. This rectangle corresponds to the surface in which the intersections of the m cathode columns and of the n grid lines are inscribed.

Conventionally, such a screen is controlled by means of an electronic circuit 20 adapted to individually addressing the conductive columns 7 of cathode 1 by connections 21 (m connections), to sequentially addressing rows 9 of grid 3 by individual connections 22 (n connections), and to biasing anode electrode 11 by means of a connection 23. In the case of a color screen with a switched anode, the sets of reed, green, blue strips or patterns are alternately biased with respect to the cathode by means of appropriate connections.

According to the preferred embodiment of the present invention, grid 3 includes, on either side of active area 17 (above and under in the orientation of FIG. 2), at least one additional conductive line 16 that does not take part in the display. The function of lines 16 is to form protective sections preventing the propagation of uncontrolled charge areas towards the neighboring portions of peripheral sealing wall 14. Lines 16 are exposed, that is, accessible by the electrons from the internal space of the screen in operation.

The other side of the active area (to the right and to the left in the orientation of FIG. 2) are associated with protective conductive sections which, in the preferred embodiment illustrated in the drawings, are formed of extensions of grid lines 9 which extend outside of active area 17. Although this has not been shown, these extensions are, preferably, as wide as possible to minimize the insulating layer portions which are accessible and likely to enable propagation of a positive charge area to the sealing wall. As will be seen hereafter, the extensions of grid lines 9 are used, on one side of the screen (to the left of FIG. 2), also as electric portions of connection of these grid lines for their respective biasing.

Preferably, the same structure is reproduced at the level of cathode 1 which then includes, on either side of active area 17 (to the right and to the left in the orientation of FIG. 2), at least one additional conductive column 15 that does not take part in the display. Columns 15 may be exposed between the extensions of grid lines 9 and 16 and then take part in the forming of the peripheral protection area. If, however, they are covered with insulating layer 8, they have no electric protection function but they enable maintaining the same pattern as in the active area, which simplifies the manufacturing by requiring no modification of the masks of formation of the cathode-grid.

Thus, the pattern of the cathode columns and of the grid rows is, preferably, continued over the entire cathode substrate 10, be it in active area 17 or outside of it. Preferably, the only optional distinction between the forming outside of active area 17 and in the active area is that the additional columns 15 that do not take part in the display, as well as the sections of columns 7 that extend outside of active area 17, may include no microtips. In this case, additional lines 16 and the sections of lines 9 that extend outside of area 17 have, preferably, no holes 4.

Columns 15 and lines 16 are addressable independently from columns 7 and lines 9. In the example shown, two additional columns 15 are provided on either side of active area 17 for what concerns the cathode and two additional rows 16 are provided as concerns the grid. The additional lines are, according to the present invention, intended for being biased to a fixed potential to create, on either side of active area 17, lines with a controlled potential and thus prevent the propagation of charge areas towards sealing wall 14. In the other direction, the extensions of lines 9 are submitted to the same biasing as the lines of active area 17 and are thus sequentially biased to a positive potential with respect to the cathode, the quiescent potential being the ground. Preferably, the additional columns are also biased to a fixed potential. If these columns have microtips, this potential must correspond to that of no emission (black). If they have no microtips and thus do not risk emitting under the effect of the biasing of the grid line extensions, it is however preferred to bias the additional columns (for example, to the ground) to avoid any floating potential in the screen. Whatever their number, the additional columns or rows are all simultaneously biased by connections, respectively 25 and 26.

An advantage of the present invention is that the forming of the peripheral protection area around the active area requires no additional manufacturing step as compared to the manufacturing of a conventional screen cathode. The number of additional columns and/or lines is chosen, according to the width of these lines and columns, to have a protection ring of sufficient general width. The use of several additional lines or columns participating in the protection ring is thus linked, according to the present invention, to the fact that the pattern of the cathode columns and the grid rows is respected over the entire substrate. Further, it should be noted that, in the case of cathode columns or grid rows having specific mesh patterns resulting in non-rectilinear conductors, this same pattern is preferably reproduced for the additional columns and rows, still with the aim of simplifying the manufacturing method.

In the case where the additional cathode columns are not exposed, that is, are coated with the insulating layer, a widening of the extensions of the grid lines may be provided with resect to their width in the active area. The insulator surface area remaining in the peripheral area, and thus the amount of secondary electrons likely to propagate, is thus minimized. Only the interval necessary to a lateral insulation between two neighboring lines are then left to remain.

If the columns are exposed, that is, accessible (which requires a modification of the mask of deposition of insulating layer 8), they then take part in the protection and it can be considered that the peripheral area is then closed, that is, that there no longer remains, in top view, insulator portions in the protection area.

An advantage of the present invention is that it respects the column and line organization of the cathode-grid. Accordingly, its implementation does not adversely affect the connection, on two sides of the cathode plate, of the columns and of the lines taking part in the display.

Figure 3:
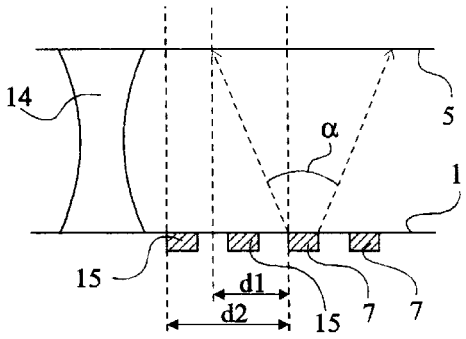
FIG. 3 schematically shows in a cross-section view an edge of a flat screen according to the present invention.

FIG. 3 shows, in a simplified cross-section view, a detail of a screen according to the present invention in the vicinity of peripheral sealing wall 14. This drawing illustrates the choice of the number of additional rows or columns according to the screen characteristics. FIG. 3 shows additional cathode columns 15, which are two with respect to the columns 7 of this cathode taking part in the display. It should however be noted that the same line of reasoning applies to additional rows 16 of the grid.

According to the present invention, the number of additional rows or columns is chosen according to the cone of electron emission by the cathode columns at the periphery of active area 17. This cone is symbolized in FIG. 3 by dotted lines making an angle $\alpha$ together. Designating by d2 the distance separating the external edge of the last display column 7 from the external edge of the last additional column 15, and designating by d1 the distance between the projection, on cathode 1, of the greatest distance of emission cone a and the external edge of the last column 7 taking part in the display, the condition of having a distance d2 greater than distance d1 must be respected. Thus, the electrons which are likely to fall back upon the grid or the cathode outside of active area 17 are necessarily collected by the peripheral protection structure of the present invention. As a specific example of embodiment, an electron emission cone in a conventional screen generally has an opening angle of approximately 30°.

An advantage of the present invention, in the embodiment that consists of keeping the cathode-grid manufacturing array and adapting the width of the protection area by the number of additional columns and lines, is that it is particularly simple to implement.

Preferably, the biasing of additional cathode columns 15 taking part in the protection is performed at a potential corresponding to no emission. Thus, for a screen having a grid biased to a potential of approximately 80 volts and the cathode columns of which are biased to levels between 0 and 40 volts according, for a monochrome screen, to the level of grey, additional columns 15 will be biased to a 40-volt potential corresponding to a black level. On the grid side, additional lines 16 are preferably biased (via a current-limiting resistor) to a fixed potential smaller than the potential of extraction of the electrons from the microtips (for the case where the additional columns are provided therewith). For example, this potential will be smaller than 40 volts and, preferably, equal to the ground, that is, at the potential of the unaddressed grid lines.

In an embodiment where grid lines 9 of active area 17 do not extend outside of said area, additional cathode columns 15 may be exposed, that is, with no insulator 8 covering them. In such an embodiment, these additional columns, as well as additional lines 16 of the grid are preferentially biased via a current-limiting resistor since they are all used to collect electrons.

In the embodiment illustrated in the drawings where the grid lines extend above additional cathode columns 15, insulator 8 is maintained in the multiple-layer so that columns 15 are not directly accessible by the electrons. In this embodiment, only additional lines 16 may be accessible and are thus biased via a Ballast resistor (not shown).

Of course, the present invention is likely to have various alterations, modifications, and improvements which will readily occur to those skilled in the art. In particular, although the foregoing description refers to an embodiment using two additional rows and two additional columns on either side of the active area, other embodiment may be envisaged according to the desired protection distances. On this regard, it should be noted that the number of additional lines may be different from the number of additional rows according, in particular, to the respective widths of these additional columns and rows. Further, adapting the screen control circuit to the implementation of the present invention is within the abilities of those skilled in the art based on the functional indications provided hereabove. It should here be noted that the present invention keeps the normal addressing of a flat screen and only adds connections for the biasing of the additional columns and rows taking part in the peripheral protection. Further, the present invention applies whatever the pattern given to the cathode columns and to the grid lines and the reference to columns and to rows is purely arbitrary, since the cathode conductors may be designated as being rows and the grid conductors may be designated as being columns, according to the screen addressing mode.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A cathode plate of a flat display screen including:

a set of electron emission cathode conductors, organized in columns;

a set of electron extraction grid conductors, organized in rows;

a peripheral protection area, surrounding an active area taking part in the display, to prevent propagation of secondary electrons out of the peripheral protection area; and at least one additional accessible conductive line on either side of the extraction grid conductors.

2. The cathode plate of claim 1, wherein the peripheral protection area is formed of a conductive ring surrounding a majority of the active area and formed in an accessible conductive level.

3. The cathode plate of claim 1, including, on either side of the electron emission cathode conductors, at least one additional conductive column.

4. The cathode plate of claim 3, wherein the grid conductors and the cathode conductors belong to a piling of thin layers with at least one interposed insulating layer, the at least one additional conductive line and/or the at least one additional conductive column being formed in respective levels of the extraction grid conductors and of the emission cathode conductors.

5. The cathode plate of claim 4, wherein the at least one additional column is at least partially accessible.

6. The cathode plate of claim 3, wherein the at least one additional conductive column is at least partially accessible.

7. The cathode plate of claim 3, wherein the emission cathode conductors extend under the at least one additional conductive line, the extraction grid conductors extending over the at least one additional conductive column.

8. The cathode plate (10) of claim 3, wherein the at least one additional conductive column is adapted to being biased to a potential corresponding, for the emission cathode conductors, to no electron emission, the at least one additional conductive line being adapted to being biased to a potential corresponding, for the extraction grid conductors, to no addressing.

9. The cathode plate (10) of claim 3, wherein the number of the at least one additional conductive column and/or the at least one additional conductive line is a function of a column and line conductor width and on an angle ($\alpha$) of an electron emission cone of the cathode conductors.

10. A flat display screen including:

a cathode provided with active electron emission regions;

a cathodoluminescent anode provided with at least one active area of phosphor elements; and a grid for extracting electrons emitted by the active regions of the cathode towards the phosphor elements, wherein the cathode and the grid are formed on a cathode plate of any of claims 1 to 9, wherein the number of additional conductive columns and/or additional conductive lines depends, along others, on a distance separating the cathode plate from the cathodoluminescent anode.

11. The screen of claim 10, further including a circuit (20) for biasing and addressing conductors of the cathode, of the grid and of the anode, provided with connections for biasing the additional conductive lines and/or conductive columns.

* * * * *